United States Patent [19]

Pellegrino

[11] Patent Number: 5,016,845

[45] Date of Patent: May 21, 1991

[54] INFANT FEEDING ASSEMBLY

[76] Inventor: Wendy M. Pellegrino, 82 Cypress Neck Rd., Lincroft, N.J. 07738

[21] Appl. No.: 460,245

[22] Filed: Jan. 2, 1990

[51] Int. Cl.[5] ..... A47D 15/00

[52] U.S. Cl. ..... 248/104; 248/910

[58] Field of Search ..... 248/102-107, 248/910, 274, 231.6, 231.5; 221/188, 189; 222/58, 52

[56] References Cited

U.S. PATENT DOCUMENTS

| | | | |
|---|---|---|---|
| 504,866 | 9/1893 | Davenport | 248/274 X |
| 580,837 | 4/1897 | Sykes | 248/104 |
| 753,683 | 3/1904 | Dixon | 248/104 |
| 773,252 | 10/1904 | Frank | 248/104 |
| 936,293 | 10/1909 | Black | 248/102 |
| 1,407,681 | 2/1922 | Saunders | 248/103 |
| 1,554,201 | 9/1925 | Dalzell | 248/103 |
| 1,867,992 | 7/1932 | Sullivan | 248/104 |
| 2,303,728 | 12/1942 | Drayton et al. | 248/104 |
| 2,412,426 | 12/1946 | Rayko | 248/105 |
| 2,448,189 | 8/1948 | Mott . | |
| 3,028,133 | 4/1962 | Craig | 248/106 |
| 3,161,392 | 12/1964 | Kopec | 248/104 |
| 3,425,653 | 2/1969 | Rauch | 248/104 |
| 4,062,510 | 12/1977 | Brochu | 248/102 |
| 4,114,847 | 9/1978 | Bogensberger | 248/104 |
| 4,799,636 | 1/1989 | Johnson | 248/105 X |

*Primary Examiner*—Karen J. Chotkowski

*Attorney, Agent, or Firm*—Terry M. Gernstein

[57] ABSTRACT

An infant feeding assembly includes an infant feeding container that is supported to return to an upright, non-leaking orientation upon being released by the infant. The container is weighted and supported to tip and twist into a bottom-down configuration when released so that fluid from the container will not leak onto the infant or the bedding, floors, car seats or the like.

9 Claims, 3 Drawing Sheets

INFANT FEEDING ASSEMBLY

TECHNICAL FIELD OF THE INVENTION

The present invention relates to the general art of dispensing containers, and to the particular field of infant feeding devices.

BACKGROUND OF THE INVENTION

The problem of holding and supporting an infant's feeding bottle has been present for many years. Those caring for infants are ever so well aware of the problems associated with holding a baby bottle in position for the baby, and retrieving a dropped bottle if the babY is permitted to hold the bottle himself.

These problems have led to a plethora of baby bottle holders. All such holders have basic criteria that must be fulfilled. Thus, for example, all such holders should support the bottle in a position that is convenient to the babY. The field of baby bottle holders includes much art directed to these problems, and such holders have worked in a somewhat successful manner.

However, these known bottle supporting means still have several drawbacks. In recent times, there has been documentation of infant deaths attributed to liquid spilling from a feeding container onto the infant. Such infants were simply given a bottle, and allowed to feed themselves. The bottles leaked fluid onto the infant after the infant had finished feeding.

Therefore, there is a need for an infant feeding assembly which will substantially eliminate the possibility of spilling fluid onto an infant who has finished feeding from the container and which returns to a non-spilling condition upon being released by the infant.

OBJECTS OF THE INVENTION

It is a main object of the present invention is to provide an infant feeding assembly which will substantially eliminate the possibility of spilling fluid onto an infant who has finished feeding from the container.

It is another object of the present invention to an infant feeding assembly which will substantially eliminate the possibility of spilling fluid onto an infant who has finished feeding from the container and which returns to a non-spilling condition upon being released by the infant.

SUMMARY OF THE INVENTION

These, and other, objects are achieved by an infant feeding assembly which includes an infant feeding container that is mounted and weighted to return to a bottom-down orientation spaced from the infant upon being released by that infant. The bottom-down orientation is established no matter how much liquid remains in the container when it is released by the infant.

In this manner, the assembly always moves into a nonspilling, bottom-down orientation whenever the assembly is not in use. This bottom-down orientation essentially eliminates the possibility that liquid will spill onto the infant when the assembly is not in use.

BRIEF DESCRIPTION OF THE DRAWING FIGURES

DETAILED DESCRIPTION OF THE PREFERRED EMBODIMENT OF THE INVENTION

Figure 1:
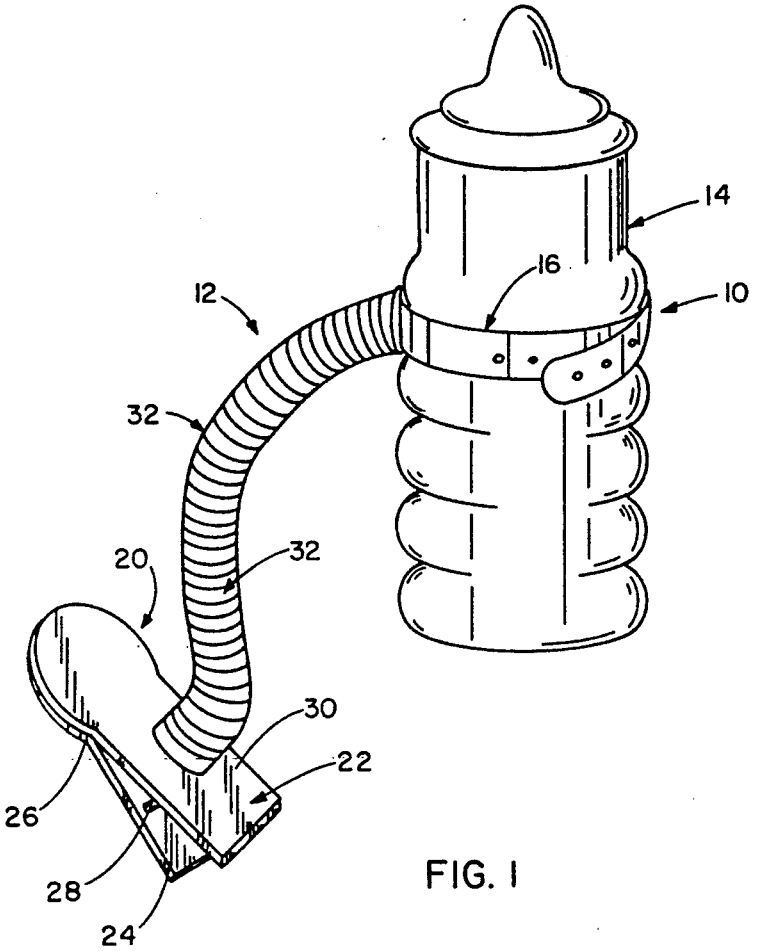
FIG. 1 is a perspective view of an infant feeding assembly embodying the invention.

Shown in FIG. 1 is an infant feeding assembly 10 of the present invention which is adapted to assume a bottom-down orientation upon being released by an infant whereby fluid, such as formula, milk, juice, water or the like, from the container is not likely to spill onto the infant.

By way of orientation, the infant feeding assembly 10 includes a support unit 12 which releasably mounts an infant feeding container 14 to a rail of a crib (not shown in FIG. 1) via a strap unit 16. The support unit 12 is biased to twist and move the container unit into a bottom-down orientation, and the container unit is weighted to co-operate with such bias to move the container into the bottom-down orientation.

The support unit 12 includes a spring-loaded clamp element 20 which is adapted to be releasably mounted on the rail of a crib in which an infant is located. The clamp element 20 includes a top jaw element 22 and a bottom jaw element 24 which are coupled together bY a pivot unit 26 and which are biased into a closed condition by a spring element 28. The top jaw element has a planar upper surface 30 which is located inside the perimeter of the crib when the assembly 10 is in use.

Figure 2:
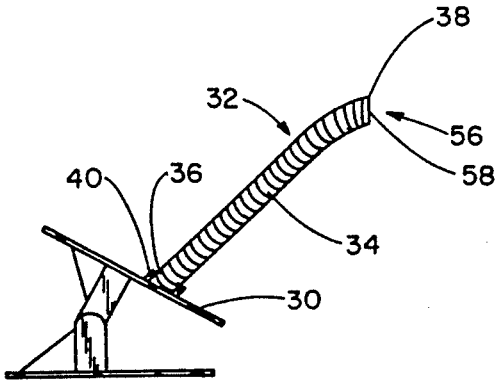
FIG. 2 is a side elevational view of a support unit of the infant feeding assembly.
Figure 3:
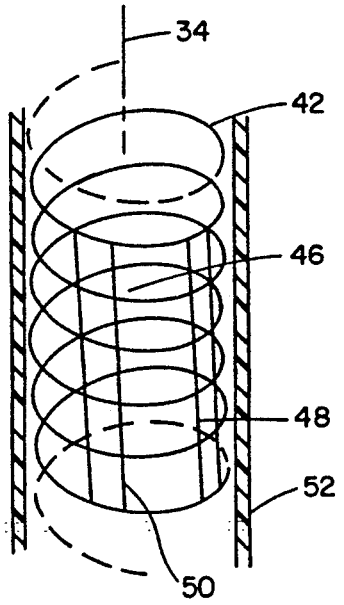
FIG. 3 is a cutaway side elevational view of a gooseneck assembly of the infant feeding assembly.

Referring next to FIGS. 1, 2 and 3, it is seen that the support unit 12 further includes a gooseneck assembly 32 which is elongate and extends from the top jaw element upper surface 30 upward therefrom. The gooseneck assembly therefore includes a longitudinal centerline 34 that extends the length of the assembly from one end 36 thereof to a second end 38 thereof. The gooseneck assembly is releasably mounted on the clamp element top jaw planar upper surface 30 by means of a collar 40.

Referring to FIG. 3, it is seen that the gooseneck assembly 32 includes a first spring element 42 that is a helical spring that has been wound to be biased to resist movement of the gooseneck assembly in a plane parallel to a plane containing the jaw top surface 30. Such bias will move the container 14 in such plane from an infant-feeding location away from that infant. The gooseneck assembly further includes a second spring means 46 that includes a plurality of elongated torsion bars, such as bars 48 and 50 attached to the first spring element 42. These torsion bars are designed and attached to the spring 42 to resist twisting movement of the gooseneck about the longitudinal centerline 34. Thus, if the container assembly 14 is twisted so that the gooseneck assembly twists about the longitudinal centerline 34, the torsion bars tend to re-establish the original orientation of the container.

Thus, when an infant grasps the feeding container and pulls it towards him, the springs 42 and 46 are bent and twisted respectively from their initial position. Such bending and twisting is resisted by the springs 42 and 46 so that as soon as the infant releases the container, that container will tend to return to its initial position under the influence of the springs 42 and 46. Suitable springs and torsion bars can be selected by those skilled in the art based on the teaching of the present disclosure and the general knowledge of springs found in standard textbooks such as "Design of Machine Elements" by V.M. Faires and published by the Macmillan Company in 1955, the disclosure of which is incorporated herein by reference, and standard handbooks such as "Marks' Standard Handbook for Mechanical Engineers", Seventh Edition, edited by T. Baumeister and published by McGraw-Hill in 1967, the disclosure of which is incorporated herein by reference.

A sleeve 52 is formed of plastics-type materials and is slidably fit over the first spring 42 into sliding and releasable engagement with the collar 40 on the clamp element top jaw. The sleeve is flexible and is used to protect the springs and is removed for cleaning.

A snap fastener ball element 56 having a snap fastener ball 58 is mounted on the second end 38 of the gooseneck assembly for a purpose to be discussed below.

Figure 4:
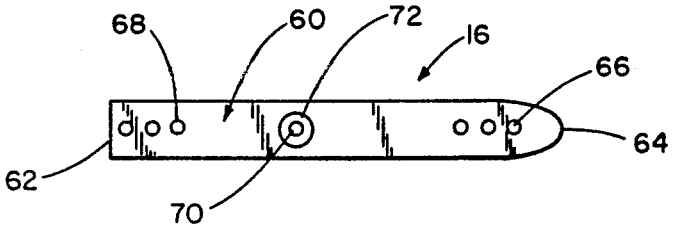
FIG. 4 is a top plan view of a strap unit of the infant feeding assembly.

Referring next to FIG. 4, the strap unit 16 is seen to include an elongate strap element 60 that has a blunt end 62 and a pointed end 64, with fasteners, such as fastener 66, located on that strap element adjacent to the pointed end 64. A plurality of fastener-receiving holes, such as hole 68, are defined through the strap element adjacent to the blunt end 62, and the fasteners 66 being received in various ones of the holes 68 to secure the strap to a container and adjust the size of the strap to fit the size and shape of the container. The strap unit is cinched up around the container to attach that container to the support unit.

A snap-fastener ball receiving socket 70 is mounted on a plate 72 affixed to the strap element 60 between the blunt end 62 and the pointed end 64. The snap fastener ball 58 is rotatably received in the ball receiving socket 70 to attach the strap, and the container held therein, to the support assembly gooseneck assembly. The strap unit is released from the gooseneck assembly for cleaning purposes.

Figure 5:
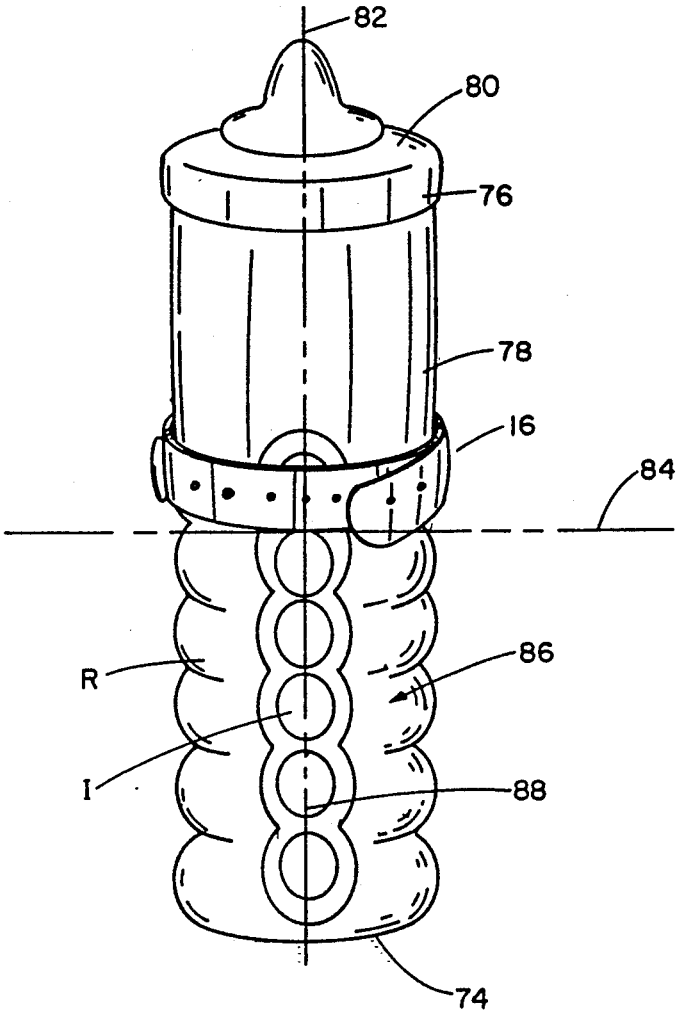
FIG. 5 is side elevational view of an infant feeding container of the infant feeding assembly.

The infant feeding container unit 14 is best shown in FIG. 5, and attention is now directed to FIG. 5 for the following discussion.

The infant feeding container 14 is preferably a baby bottle, but could be any other suitable container. The baby bottle form of the container includes a bottom 74, a top 76 and a cylindrical wall 78 connecting the bottom and the top. An infant feeding element, such as a nipple unit 80, is releasably attached to the bottle top, and the bottle includes a longitudinal centerline 82 extending from the bottom to the top and a transverse centerline 84 extending orthogonally to the longitudinal centerline.

As shown, the strap unit 16 engages the baby bottle between the transverse centerline 84 and the top 76 so that the bottle is balanced to tip towards the bottom. This tipping effect will be assisted by the weight of fluid contained in the bottle.

The bottle further includes a weight assembly 86 in the bottle sidewall 78 for further emphasizing the just-mentioned tipping effect of the bottle. The weight assembly 86 includes a plurality of weight elements, such as ball 88, embedded in the sidewall material. All of the weight elements have different weights so that each weight element has a weight that is different from all other weight elements. The weight elements are positioned in a linear arrangement and are spaced apart from each other a distance that will define a finger-grip portion of the bottle. The weights extend from adjacent to the bottom 74 to adjacent to the transverse centerline where the strap unit engages the bottle. Such placement locates the weights in the bottom half of the bottle whereby the bottom-uprighting action of the bottle is assisted. Thus, due to the weight distribution of the bottle and the location of the strap unit on that bottle, left alone, the bottle will tend to tip into a bottom-down orientation as shown in FIGS. 1 and 5.

The weight elements are arranged so that the heaviest weight element is located adjacent to the bottom 74 and the lightest weight element is located adjacent to the transverse centerline 84, and each weight is lighter than its immediately adjacent superadjacent neighbor. That is, of any two adjacent weight elements, the heavier of the two will be located closer to the bottom 74.

The total combined weight of the all of the weight elements is such that the center of gravity of the container is always located below the strap unit 16 no matter how much fluid is contained in that container. This lowering of the center of gravity of the container will further assist in the bottom-down bias of that container when it is attached to the remainder of the assembly. The organization of the weight elements to have the heavier of any two adjacent weight elements located closer to the bottom will maintain the weighted portion of the container beneath the surface of the contents of the container as that contents is dispensed from the container until the container is completely empty.

The weights can have various indicia I, such as numbers, letters, figures or the like and can be colored to retain the attention of the infant. Furthermore, the container can include ribs R which spaced apart to correspond to the spacing of the weight elements to further define the gripping portion of the container.

Figure 6:
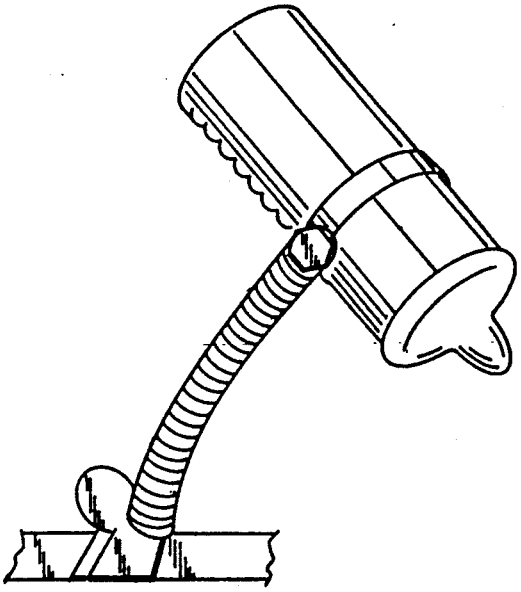
FIG. 6 is a side elevational view illustrating the infant feeding assembly in an infant-feeding orientation.
Figure 7:
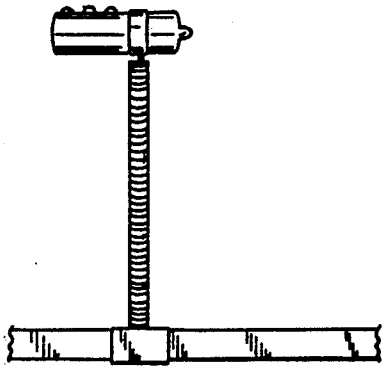
FIG. 7 is a side elevational view illustrating the infant feeding assembly in an intermediate orientation.
Figure 8:
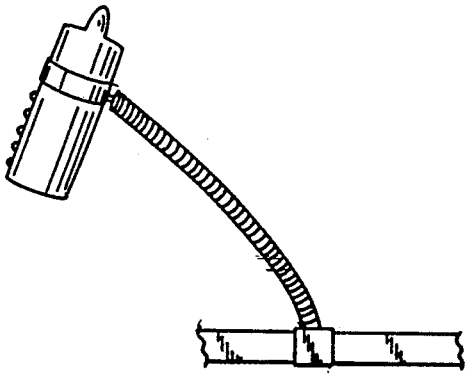
FIG. 8 is a side elevational view illustrating the infant feeding assembly in a bottom-down at rest orientation.

The bottom-down tipping action of the assembly is illustrated in FIGS. 6–8. The bottle is shown in a feeding position in FIG. 6 in which the bottle is inverted with the top 76 is positioned on the bottom so that fluid contained in the bottle can be withdrawn from the nipple unit 80 by an infant. When the infant releases the bottle, the spring 42 tends to pull the bottle upwardly towards the FIG. 7 intermediate position in a plane parallel to the top surface 30 of the top jaw. This bias by the spring 42 moves the bottle towards and into the FIG. 7 intermediate orientation, from which point, the uprighting bias exerted on the bottle by the weight elements and the location of the strap unit will tend to continue the tipping action of the bottle. The bottle continues to tip upright and moves into the bottom down orientation shown in FIG. 8 due to the weights and the position thereof in the lower portion of the bottle beneath the strap unit.

The spring means 50 will tend to twist the bottle about the longitudinal centerline 82 and move it into the proper orientation and works in conjunction with the spring 42 to produce the just-discussed bottle uprighting action.

It is understood that while certain forms of the present invention have been illustrated and described herein, it is not to be limited to the specific forms or arrangements of parts described and shown.

I claim:

1. An infant feeding assembly comprising:

(A) a support unit which includes (1) a spring-loaded clamp element which is adapted to be releasably mounted on a crib and which includes a top jaw and a bottom jaw which are held together by a pivot element and which are biased into a crib contacting position by a clamp spring (2) an elongate flexible gooseneck assembly mounted at one end thereof on said top jaw, said gooseneck assembly including (a) a longitudinal centerline extending from said top jaw, (b) a first spring element which is mounted at one end thereof on said clamp element top jaw and which is biased to resist movement of said gooseneck assembly in a plane parallel to a plane containing said top jaw, and (c) a second spring means connected to said first spring element and being biased to resist a twisting movement of said gooseneck assembly about said gooseneck assembly longitudinal centerline, (3) a snap fastener ball element mounted on a second end of said first spring element, and (4) a flexible sleeve releasably mounted at one end thereof on said top jaw and releasably containing said first spring and said second spring means;

(B) a strap unit having ends and releasably attached to said gooseneck assembly and including (1) a plurality of fasteners near one end thereof, (2) a plurality of fastener-receiving holes defined therethrough near another end thereof, (3) a snap fastener ball receiving socket located between said strap ends; and (C) an infant feeding container unit being releasably mounted onto said support unit by said strap unit and which includes (1) a top adapted to receive a fluid dispensing element releasably mounted thereon, (2) a bottom, (3) a sidewall connecting said top to said bottom, (4) a longitudinal centerline extending between said bottom and said top, (5) a transverse centerline extending perpendicular to said longitudinal centerline, said strap unit engaging said infant feeding container unit between said transverse centerline and said container, and (6) a weight assembly in said sidewall and including (a) a plurality of weight elements, each having a weight which is different from the weight of all other weight elements, (b) said weight elements being positioned in a linear arrangement and spaced apart from each other along said container sidewall from adjacent to said bottom to adjacent to said transverse centerline, (c) said weight elements being arranged to have the heaviest weight element located closest to said bottom and the lightest weight located adjacent to said transverse centerline and to have the heavier of any two adjacent weight elements located closer to the bottom than the lighter of said any two adjacent weight elements, and (d) said weight elements having a total combined weight which lowers a center of gravity of said container unit beneath said transverse centerline.

2. The infant feeding assembly defined in claim 1 wherein said infant feeding container includes a baby bottle, and said container sidewall is cylindrical.

3. The infant feeding assembly defined in claim 2 further including indicia on each weight element.

4. The infant feeding assembly defined in claim 3 wherein said clamp element includes a collar element mounted on said top jaw.

5. The infant feeding assembly defined in claim 4 wherein said flexible sleeve is formed of plastics-type material.

6. The infant feeding assembly defined in claim 5 wherein said weight elements are spaced apart far enough to form a fingergrip pattern on said container sidewall.

7. The infant feeding assembly defined in claim 6 further including a plurality of spaced-apart ribs on said infant feeding container.

8. The infant feeding assembly defined in claim 7 wherein said second spring means includes a plurality of torsion bar elements.

9. The infant feeding assembly defined in claim 8 wherein said first spring element includes a helical spring.

* * * * *